United States Patent [19]

Haak et al.

[11] 4,126,083

[45] Nov. 21, 1978

[54] ATTITUDE CONTROL FOR IMPLEMENT

[75] Inventors: Willard J. Haak, Peoria; Howard A. Marsden, Pekin; Orrin A. Stemler, East Peoria, all of Ill.

[73] Assignee: Caterpillar Tractor Co., Peoria, Ill.

[21] Appl. No.: 766,102

[22] Filed: Feb. 7, 1977

[51] Int. Cl.[2] ..... B66F 9/00

[52] U.S. Cl. ..... 91/176; 137/596.12; 173/43; 214/771; 299/37; 91/183

[58] Field of Search ..... 214/138 R, 771; 173/43, 173/19; 299/69, 71, 37; 37/DIG. 1; 91/414; 137/596.12

[56] References Cited

U.S. PATENT DOCUMENTS

| | | | |
|---|---|---|---|
| 3,179,120 | 4/1965 | Erickson et al. | 137/101 |
| 3,251,277 | 5/1966 | Stacey | 137/596.12 |
| 3,374,975 | 3/1968 | Bronder | 173/43 X |
| 3,395,816 | 8/1968 | Hodges et al. | 214/138 R |
| 3,563,137 | 2/1971 | Graber | 91/414 |
| 3,868,145 | 2/1975 | Cobb | 299/70 |
| 4,066,004 | 1/1978 | Alcalay | 91/176 X |

*Primary Examiner*—Ernest R. Purser
*Assistant Examiner*—William F. Pate, III
*Attorney, Agent, or Firm*—Phillips, Moore, Weissenberger, Lempio & Majestic

[57] ABSTRACT

In a vehicle including a stick cylinder movable to change the attitude of a stick relative to a boom, and an implement cylinder movable to change the inclination of an implement relative to the stick, hydraulic circuit means are provided for serially connecting the cylinders so that as the stick cylinder moves the stick in one direction, discharge of fluid from the stick cylinder is used to actuate the implement cylinder to maintain substantially the same attitude of the implement relative to the ground. A flow divider is interposed between the cylinders to provide the desired degree of actuation of the implement cylinder in response to actuation of the stick cylinder. A dual pressure-responsive bypass valve provides a relatively high pressure relief to the implement cylinder when the implement cylinder is operated independently of the stick cylinder and provides a relatively low discharge path for the implement cylinder when operated in series with the stick cylinder.

9 Claims, 3 Drawing Figures

ATTITUDE CONTROL FOR IMPLEMENT

BACKGROUND OF THE INVENTION

This invention relates to a vehicle incorporating a movable implement associated therewith, and more particularly to means for providing a coordination of movement in a stick arm and the implement associated with the vehicle.

In vehicles incorporating a raisable and lowerable boom, a stick arm pivotally mounted to the boom, and an implement pivotally mounted to the stick arm, it is necessary that the movements of the stick arm and implement be properly coordinated under various operating conditions. This is generally accomplished by means of hydraulic cylinders and an associated hydraulic control system for the cylinders. In general, one cylinder is extendable and retractable to pivot the stick arm relative to the boom, and another cylinder is extendable and retractable to pivot the implement relative to the stick arm. Yet another cylinder interconnects the frame of the vehicle and the boom for overall raising and lowering of the boom.

In a typical system of this type incorporating, for example, a rock-breaking implement, if the stick arm cylinder is actuated in one direction, the entire assembly made up of the stick arm, rock-breaking implement, and implement cylinder, is pivoted as a unit relative to the boom. Thus, under such conditions, the tooth of the rock-breaking implement changes in attitude relative to, for example, a vertical, or a horizontal surface on which the tooth works. It has been found desirable that the attitude of such implement and tooth thereof remain generally the same relative to such vertical or horizontal surface during the swinging of such assembly due to actuation of the stick arm cylinder. It will be understood that during the normal operation of such an apparatus, in order to achieve a generally unchanging attitude of the implement relative to such vertical or horizontal earth surface, the operator of the vehicle must actuate the implement cylinder in a very precise manner. This may not always be feasible or convenient, due to, for example, poor operator visibility or difficulty in simultaneously operating the controls of the stick arm cylinder and implement cylinder.

Of general interest in this area are U.S. Pat. No. 3,179,120, incorporating a flow divider for dividing flow between a boom cylinder and an implement cylinder. Also, of general interest in this area are U.S. Pat. No. 3,175,580, and U.S. Pat. No. 2,998,891, each incorporating spool-type control valves for achieving bucket leveling.

SUMMARY OF THE INVENTION

It is accordingly an object of this invention to provide apparatus which operatively interconnects the stick arm cylinder and the implement cylinder of a vehicle for maintaining a chosen attitude of the implement during actuation of the stick arm cylinder through coordination of the movements of the stick arm cylinder and implement cylinder.

It is a further object of this invention to provide apparatus which, while fulfilling the above object, is extremely simple in design and convenient in use.

Broadly stated, the invention is in a vehicle including first and second fluid cylinders actuatable to actuate means operatively associated with the vehicle. The invention comprises a fluid pump, and means operatively connecting the pump with the first cylinder for selectively applying fluid pressure to one end of the cylinder to actuate the cylinder in one direction. Means operatively connect the other end of the first cylinder and one end of the second cylinder for selectively providing that a portion of the fluid flow from the other end of the first cylinder is applied to actuate the second cylinder in one direction.

A flow divider is used to apply only that portion of the fluid flow from the other end of the first cylinder to the second cylinder as is required to produce the desired amount of actuation of the second cylinder in response to a given amount of actuation of the second cylinder.

A normally closed bypass valve means is connected to the other end of the second cylinder for providing a relatively high pressure relief when the second cylinder is not actuated in response to actuation of the first cylinder and a relatively low pressure discharge path when the second cylinder is actuated in response to actuation of the first cylinder.

BRIEF DESCRIPTION OF THE DRAWINGS

These and other objects of the invention will become apparent from a study of the following specification and drawings, in which.

DESCRIPTION OF THE PREFERRED EMBODIMENT

Figure 1:
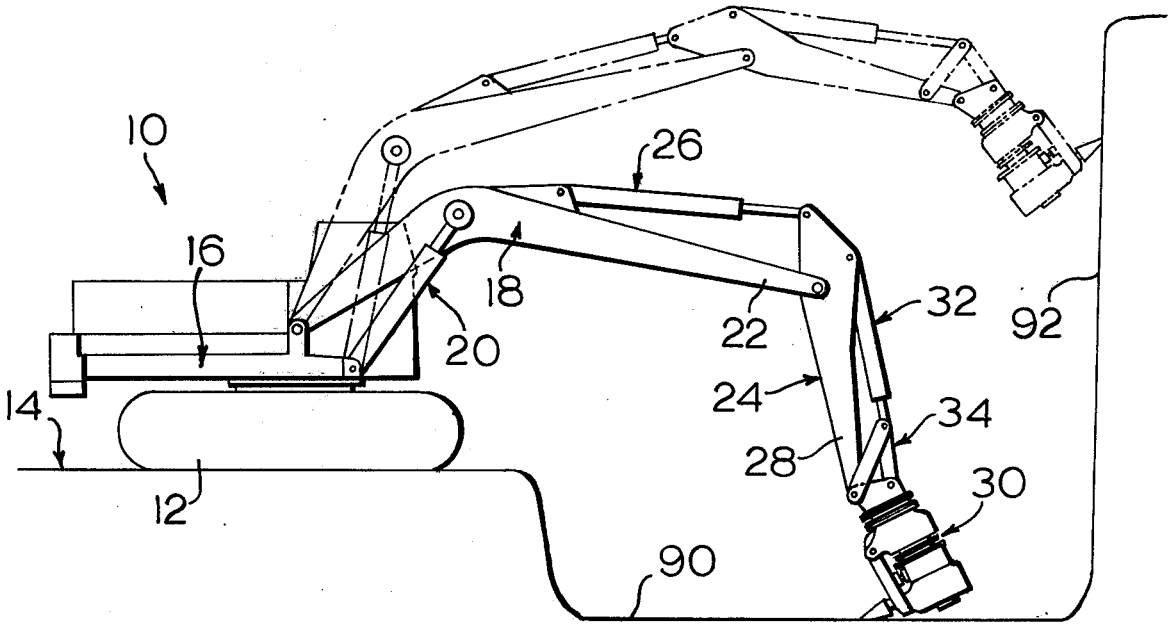
FIG. 1 is a side elevation of the overall apparatus incorporating the invention.

Shown in FIG. 1 is a track-type vehicle 10 having the tracks 12 thereof disposed on the ground 14. The frame 16 of the vehicle 10 has pivotally mounted thereto and extending forwardly therefrom a boom 18. An extendable and retractable hydraulic cylinder 20 interconnects the frame 16 and boom 18 for selective raising and lowering of the boom 18. The extended end 22 of the boom 18 has pivotally mounted thereto a stick arm 24. A stick arm cylinder 26 interconnects the boom 18 and stick arm 24, and is extendable and retractable as will be further described to provide pivoting motion of the stick arm 24 relative to the boom 18. The extended end 28 of the stick arm 24 has pivotally mounted thereto a rock-breaking implement 30, and an extendable and retractable cylinder 32 interconnects the stick arm 24 and a linkage 34 coupled to the stick arm 24 and implement 30, so that extension and retraction of the implement cylinder 32 pivots the implement 30 relative to the stick arm 24, in a manner to be described further on.

Figure 3:
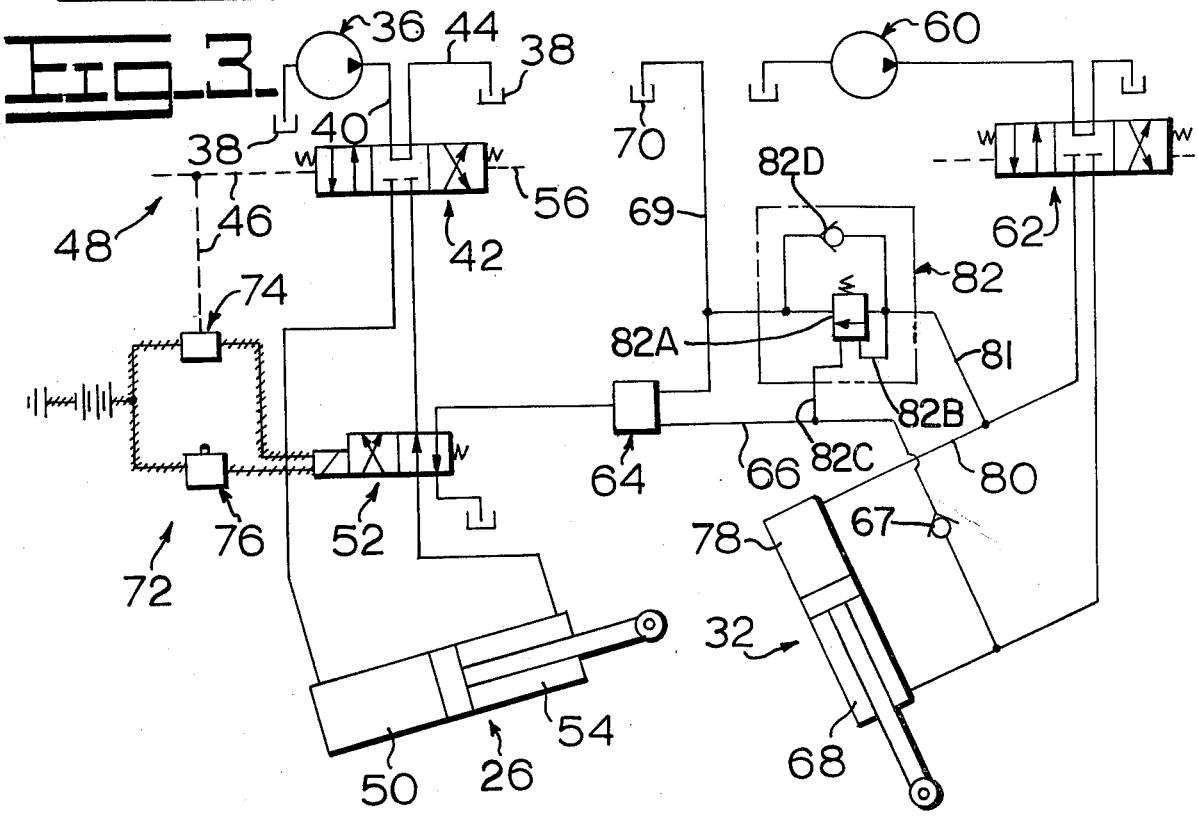
FIG. 3 is a schematic view of the fluid circuitry of the apparatus of FIGS. 1 and 2.

Referring to FIG. 3, a hydraulic pump 36, driven by the engine of the vehicle 10, is connected with a source of hydraulic fluid 38. The pump 36 feeds through a conduit 40 to a valve 42. The valve 42 is movable to a first position as shown in FIG. 3, wherein fluid applied to such valve 42 is directed therefrom through a conduit 44 to tank 38. With the valve 42 in such first position, the pump 36 is blocked from communication with the cylinder 26. The valve 42 is movable to a second position upon application of fluid pressure thereto in conduit 46 of a pilot system 48. With the valve 42 in such second position, communication is provided between the pump 36 and the one or head end 50 of the cylinder 26. A second valve 52 is included, as shown, movable to the first position shown in FIG. 3, wherein exhaust fluid from the rod or other end 54 of the cylinder 26 is allowed to pass through the valve 52, and through the valve 42 and conduit 44 to discharge at low pressure to tank 38. Pilot pressure applied in conduit 56 to the other side of the valve 42 moves the valve 42 to a third position wherein the rod end 54 of the cylinder 26 is communicated with the pump 36, and the head end 50 of the cylinder 26 is communicated to tank 38, to actuate the cylinder 26 in the other direction.

A second pump 60 is driven by the engine of the vehicle 10, and is operatively connected with the cylinder 32 through a valve 62, in the same manner as the valve 42 and cylinder 26.

It will thus be seen that the cylinder 32 may be actuated in one and the other directions as chosen, and the cylinder 26 may be actuated in one and the other directions as chosen, independently of each other.

With the valve 52 in its first position, communication between cylinders 26 and 32 is blocked and the rod end 54 of cylinder 26 is connected by valve 52 to valve 42 so that the rod end 54 may be pressured from pump 36 or may discharge through conduit 44 depending upon whether valve 42 has been moved in the appropriate direction from neutral position. Valve 52 is movable to a second position wherein the rod end 54 of cylinder 26 is operatively connected to cylinder 32 so that fluid from the rod end 54 of cylinder 26 can flow to the adjustable flow divider 64 with a desired portion of such fluid then flowing through conduit 66 and check valve 67 to the rod end 68 of cylinder 32. The remainder of the fluid flowing to flow divider 64 passes through the low pressure discharge conduit 69 to tank 70.

The valve 52 is operatively coupled with an electrical circuit 72 such that a pair of electrical switches 74 and 76 must both be closed to cause valve 52 to move to its second position wherein it fluidly connects cylinders 26 and 32.

Switch 74 is closed in response to pilot pressure in line 46. Switch 76 is manually operable and serves as a mode selector switch whereby the operator can choose between an independent operation mode of cylinders 26 and 32 (switch 76 is open) and an automatic-attitude mode (switch 76 is closed). As is apparent, valve 52 will be shifted to its second position only when the manually operable switch 76 is closed and valve 42 is in its second position. If valve 42 is in its first or third position, or if switch 76 is open, then valve 52 will be in its illustrated first position.

When valve 42 has been shifted to its second position to cause extension of cylinder 26 and valve 52 has been moved to its second position so that fluid discharging from the rod end 54 of cylinder 26 is applied to the rod end 68 of cylinder 32 to cause retraction thereof, fluid is forced from the head end 78 of cylinder 32 through conduits 80 and 81, to and through valve 82A of valve unit 82 to discharge line 69 and tank 70.

Valve unit 82, as shown in FIG. 3, is a conventional and commercially available unit which includes a valve 82A used herein as a bypass valve, such valve being biased to closed position and openable in response to the combined total of the fluid pressures applied thereto through conduits 82B and 82C. Conduit 82B is connected to conduit 81 to apply pressure existing in the head end 78 of cylinder 32 to bypass valve 82A, and conduit 82C is connected to conduit 66 so that the pressure of the fluid flowing therethrough will be applied to valve 82A, for the reasons set forth in the discussion of operation. Commercially available valve units 82 as illustrated herein also include an integral check valve 82D in parallel with valve 82A. In the present system, check valve 82D remains closed at all times.

OPERATION

As is apparent from the above, the operator may choose to operate the stick and implement cylinders 26 and 32 independently of each other, or he may close the mode selector switch 76 so that the cylinders 26 and 32 will operate in an automatic-attitude mode.

Regardless of whether switch 76 is open or closed, extension and retraction of the stick cylinder 26 is controlled solely by operation of pilot-operated valve 42. Thus, if switch 76 is open, valve 52 remains in its first position shown in FIG. 3 so that the head and rod ends are connected to valve 42 at all times. If switch 76 is closed, valve 52 still remains in the position shown in FIG. 3 when valve 42 is used to retract cylinder 26 or when valve 42 is in its illustrated blocking position. If switch 76 is closed and pilot pressure has been applied to shift valve 42 to a position to apply fluid pressure to the head end of cylinder 26 for extension thereof, valve 52 will shift to a position connecting the rod end 54 of cylinder 26 to the flow divider 64 rather than to the discharge conduit 44. However, for a given amount of fluid applied to the head end of cylinder 26, the amount of extension of that cylinder will be the same whether the rod end discharges through valve 42 or the flow divider 64.

When switch 76 is open, for independent operation of cylinders 26 and 32, extension and retraction of the implement cylinder 32 is controlled solely by operation of valve 62. When valve 62 is shifted from its first illustrated position to a second position to apply fluid pressure to the head end 78 of cylinder 32 the cylinder will extend. Bypass valve 82A is used for pressure relief purposes to protect the cylinder 32 against damage in the event of excessive loading imposed on the cylinder. For example, if valve 62 is in a position other than that wherein cylinder 32 is to retract, a force on the implement 30 which imposes a retracting force on the cylinder will cause the pressure in the head end of the cylinder to build up. To prevent stresses from becoming too great, valve 82A is set to open at a predetermined pressure level. Naturally, such level must be greater than the maximum pressure which would be applied to the head end of cylinder 32 for cylinder extension during normal operation. Since conduit 66 is unpressured when cylinder 32 is being operated in the independent mode, no pressure is applied to valve 82A by conduit 82C and valve 82A will open only when the pressure in the head end of cylinder 32 is high enough to supply enough pressure through conduit 82B to valve 82A to cause it to open and provide the desired pressure relief.

When valve 62 is moved to its third position it will apply pump pressure to the rod end of cylinder 32 to cause cylinder retraction. Check valve 67 is provided to prevent flow of such pressure fluid to conduit 66.

Figure 2:
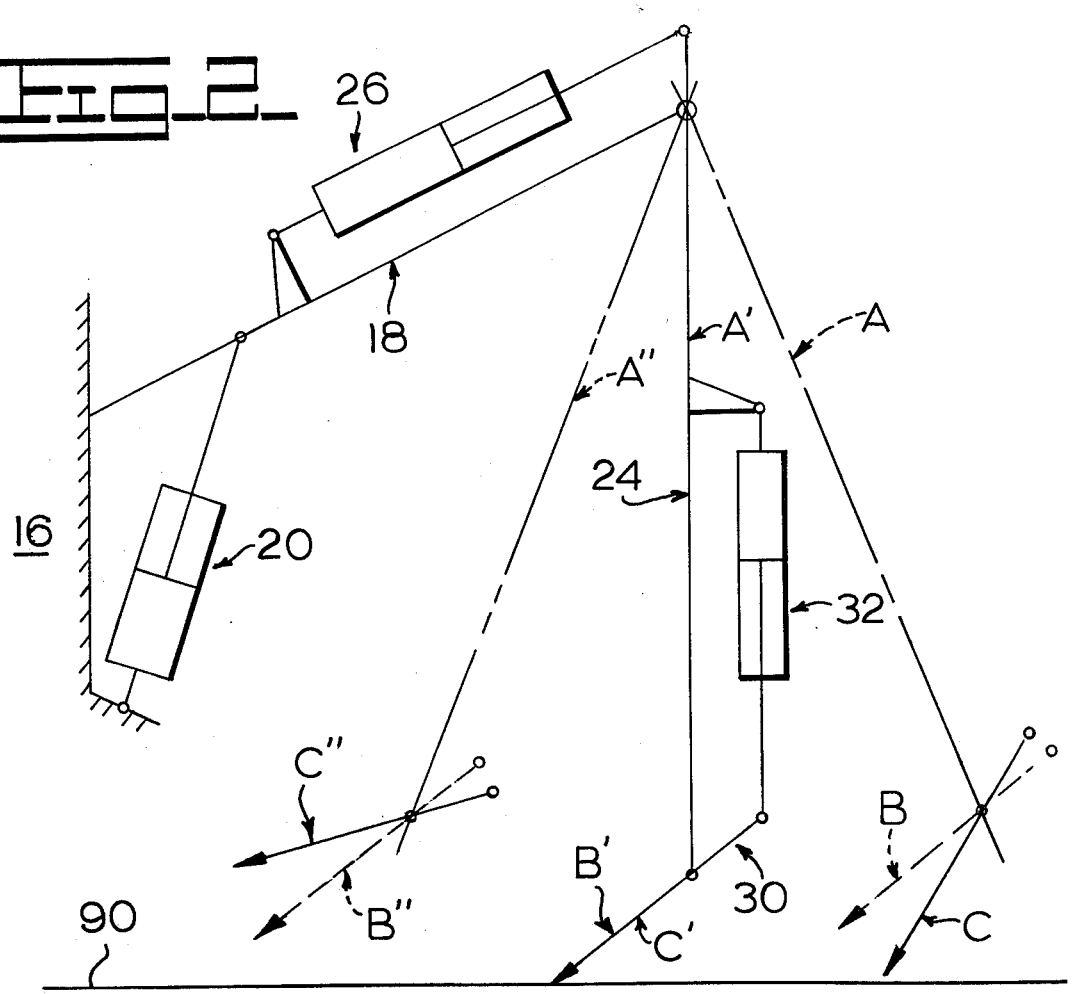
FIG. 2 is a schematic drawing showing the overall general operation of the apparatus of FIG. 1.

When the vehicle operator wishes to go into the automatic-attitude mode he closes switch 76. Valve 42 is then used to retract the stick cylinder 26 to move the stick 24 to an initial stick attitude as shown at A on FIG. 2. Valve 62 is then used to extend or retract the implement cylinder 32 to set the implement 30 at a desired attitude, e.g., as shown at B on FIG. 2. Valve 62 is returned to its first, or blocking, position.

Valve 42 is now actuated to extend the stick cylinder 50 and draw the stick towards the operator and swing the stick through positions A′ and A″. Meanwhile, with switch 76 closed and with switch 74 closed by the pilot pressure applied to valve 42, valve 52 will be shifted to the position wherein the fluid forced from the rod end of cylinder 26 will flow to the flow divider 64, with a portion of such fluid then flowing through conduit 66 and check valve 66A to the rod end of cylinder 32, so that cylinder 32 will retract. Such retraction will cause the inclination of the rock-breaking implement 30 to change relative to the stick so that the attitude of the implement to the horizontal face 90 of the ground stays the same, i.e., as shown at B′ and B″. Without such retraction of cylinder 32 the attitude of the implement to the ground would vary, e.g., as shown at C, C′ and C″ as the stick 30 is moved by extension of cylinder 26.

As is apparent, the relative amounts of retraction of the two cylinders 26 and 32 must be correlated to keep the attitude of the implement to the ground constant as the stick 30 is moved. The geometry of the stick and implement system will determine how much retraction of cylinder 32 is required for a given amount of retraction of cylinder 26. Likewise, the relative sizes of cylinders 26 and 32 will determine how much retraction of cylinder 32 will result from a given amount of retraction of cylinder 26. The flow divider 64 provides a simple and effective solution to cylinder correlation since the flow divider can be adjusted to allow only a desired proportion of the fluid discharged from cylinder 26 to be used to retract cylinder 32. Thus, for a given system, it is determined how much retraction of cylinder 32 is required for a given amount of retraction of cylinder 26 and the flow divider 64 is set so that when cylinder 26 is retracted the correct amount of fluid from cylinder 26 is used to retract cylinder 32.

As fluid is introduced through check valve 67 into the rod end 68 of cylinder 32, a corresponding amount of fluid must be discharged from the rod end thereof through the bypass valve 82A, since valve 62 is in its blocking position. The pressure of the fluid flowing through conduit 66 to the rod end of cylinder 32 is applied through conduit 82C to bypass valve 82A while the pressure in the head end of cylinder 32 is applied through conduit 82B to bypass valve 82A. Since the pressure in the head end of cylinder 32 is a function of the pressure applied through conduit 66 to the rod end, valve 82A will open when the pressure in conduit 66 exceeds a predetermined value. Such value, with pressures applied to valve 82A through both conduits 82B and 82C, is of course substantially lower than the pressure required in the head end of cylinder 32 to open valve 82A during independent operation of cylinder 32 when no pressure is present in conduit 66. Thus, during the automatic-attitude mode of operation, cylinder 32 can discharge at a relatively low operating pressure, to increase the efficiency of operation.

As a consequence, the normally closed bypass valve is responsive to the fluid pressures in conduit 66 and in the head end of cylinder 32 and functions to connect the head end of cylinder 32 to the discharge conduit 69 either when the pressure in conduit 66 exceeds a predetermined value (i.e., when the bypass valve functions as a relatively low pressure relief valve during automatic-attitude operation) or when the pressure in conduit 66 is below such value and the pressure in the head end of cylinder 32 is substantially greater than such value (i.e., when the bypass valve functions as a relatively high-pressure relief valve during either mode of operation).

If while operating in the automatic-attitude mode, movement of the stick and implement is impeded so that cylinder 26 cannot further retract, the pressure in conduits 66 and 82C will drop. Cylinder 32, however, will still be protected against excess loading forces thereon since if such forces cause the pressure in the head end 78 thereof to build up, the pressure in conduit 82B alone will cause valve 82A to open, and thereby function as a high-pressure relief valve, as in the independent cylinder operation mode.

It is to be understood that the conduit 66 could communicate with the head end 78 of the cylinder 36 through conduit 80, and not the rod end 68, i.e., the head and rod end connections of the cylinder 32 would be reversed in the system. The implement may be reversed as shown in phantom in FIG. 1, to provide that the implement attitude remains proper relative to a vertical ground surface 92, through the interaction of the cylinders 26, 32 as above described.

The embodiments of the invention in which an exclusive property or privilege is claimed are defined as follows:

1. A cylinder control system comprising:

first and second fluid cylinders, means for applying fluid under pressure to said cylinders and including a first valve having a first position blocking flow of fluid under pressure to said first cylinder and a second position allowing flow of fluid under pressure to one end of said first cylinder and including a second valve having a first position blocking flow of fluid under pressure to said second cylinder and a second position allowing flow of fluid under pressure to one end of said second cylinder, means including a first conduit operatively and fluidly connecting the other ends of said first and second cylinders and including means for allowing fluid flow through said conduit from said first to said second cylinder and preventing fluid flow through said conduit from said second to said first cylinder, a low-pressure discharge conduit, normally closed bypass valve means responsive to fluid pressures in said first conduit and in said one end of said second cylinder for connecting said one end of said second cylinder to said discharge conduit either when:

(1) the pressure in said first conduit exceeds a predetermined value, or when:

(2) the pressure in said first conduit is below said predetermined value and the pressure in said one end of said second cylinder is substantially greater than said predetermined value.

2. A cylinder control system as set forth in claim 1 wherein said bypass valve means comprises a single valve openable in response to the total combined pressure of the fluid pressures in said first conduit and in said one end of said second cylinder.

3. A cylinder control system as set forth in claim 1 wherein said means operatively connecting said other ends of said first and second cylinders includes flow divider means for allowing only a predetermined portion of fluid from said first cylinder to flow to said second cylinder.

4. A cylinder control system as set forth in claim 1 wherein said second valve has a third position allowing flow of fluid under pressure to said other end of said second cylinder.

5. A cylinder control system as set forth in claim 1 wherein said first valve has a third position allowing flow of fluid under pressure to said other end of said first cylinder, and wherein said means operatively connecting the other ends of said first and second cylinders includes means for preventing fluid flow from said first cylinder to said second cylinder when said first valve is in its third position.

6. A cylinder control system as set forth in claim 5 wherein said means operatively connecting said other ends of said first and second cylinders includes flow divider means for allowing only a predetermined portion of fluid from said first cylinder to flow to said second cylinder.

7. A cylinder control system as set forth in claim 1 wherein said first valve has a third position allowing flow of fluid under pressure to said other end of said first cylinder, said system further including a manually operable mode selector member, and wherein said means operatively connecting said other ends of said first and second cylinders includes means for allowing flow from said first cylinder to said second cylinder only when said first valve is in its second position and said mode selector member has been operated.

8. A cylinder control system as set forth in claim 7 wherein said means operatively connecting said other ends of said first and second cylinders includes flow divider means for allowing only a predetermined portion of fluid from said first cylinder to flow to said second cylinder.

9. A cylinder control system as set forth in claim 7 wherein said second valve has a third position allowing flow of fluid under pressure to said other end of said second cylinder.

* * * * *